US008128092B2

(12) United States Patent
Ritter

(10) Patent No.: US 8,128,092 B2
(45) Date of Patent: Mar. 6, 2012

(54) GAME

(75) Inventor: Janice E. Ritter, Redondo Beach, CA (US)

(73) Assignee: Mattel, Inc., El Segundo, CA (US)

( * ) Notice: Subject to any disclaimer, the term of this patent is extended or adjusted under 35 U.S.C. 154(b) by 30 days.

(21) Appl. No.: 12/544,888

(22) Filed: Aug. 20, 2009

(65) Prior Publication Data

US 2010/0044962 A1 Feb. 25, 2010

Related U.S. Application Data

(60) Provisional application No. 61/090,241, filed on Aug. 20, 2008.

(51) Int. Cl.
*A63F 1/00* (2006.01)

(52) U.S. Cl. ..... 273/292

(58) Field of Classification Search ..... None
See application file for complete search history.

(56) References Cited

U.S. PATENT DOCUMENTS

| | | | | | |
|---|---|---|---|---|---|
| 680,175 | A | * | 8/1901 | Reinhart | 273/355 |
| 1,334,954 | A | | 3/1920 | Jancek | |
| 1,402,637 | A | * | 1/1922 | Miller | 273/357 |
| 1,433,335 | A | | 10/1922 | Bensch | |
| 2,722,211 | A | | 11/1955 | Eisele | |
| 2,799,501 | A | | 7/1957 | Barbolla | |
| 2,998,673 | A | | 9/1961 | Rhodes | |
| 3,305,236 | A | * | 2/1967 | Glass et al. | 273/357 |
| 3,398,956 | A | * | 8/1968 | Lukes | 273/355 |
| 3,582,075 | A | | 6/1971 | Glass et al. | |
| 3,582,079 | A | | 6/1971 | Breslow | |
| 3,596,908 | A | | 8/1971 | Long et al. | |
| 3,622,160 | A | | 11/1971 | Barfield | |
| 3,669,451 | A | | 6/1972 | Welbourn | |
| 3,837,648 | A | | 9/1974 | Breslow | |
| 3,899,173 | A | | 8/1975 | Zaris | |
| 3,953,027 | A | | 4/1976 | Katzman et al. | |
| 3,997,163 | A | | 12/1976 | Cooper et al. | |
| 4,036,492 | A | | 7/1977 | Breslow | |
| 4,120,500 | A | * | 10/1978 | Montanarello | 273/358 |
| 4,126,309 | A | | 11/1978 | Hicks et al. | |
| 4,243,227 | A | * | 1/1981 | Strongin | 273/357 |
| 4,273,341 | A | * | 6/1981 | Warrix | 273/357 |
| 4,288,076 | A | | 9/1981 | Oyague et al. | |

(Continued)

FOREIGN PATENT DOCUMENTS

WO 2004103494 A2 12/2004

OTHER PUBLICATIONS

International Search Report for PCT/US2009/054511 dated Apr. 1, 2010.

(Continued)

*Primary Examiner* — Alvin Hunter
*Assistant Examiner* — Dolores Collins
(74) *Attorney, Agent, or Firm* — Cantor Colburn LLP

(57) ABSTRACT

A game having a plurality of game cards, a plurality of targets, a plurality of objects; and a launcher for launching at least one of the objects at one of the plurality of targets is disclosed. The game also includes at least one special game card, the at least one special game card being played to launch one of the plurality of objects at one of the plurality of targets.

14 Claims, 3 Drawing Sheets

U.S. PATENT DOCUMENTS

| | | | | |
|---|---|---|---|---|
| 4,331,334 | A | 5/1982 | Clemmer | |
| 4,726,592 | A | 2/1988 | Callaham | |
| 4,733,871 | A * | 3/1988 | McQueeny et al. | 273/399 |
| 4,807,885 | A | 2/1989 | Chamblee et al. | |
| 5,104,124 | A | 4/1992 | Bernard et al. | |
| 5,150,898 | A | 9/1992 | Hochberg et al. | |
| 5,213,334 | A | 5/1993 | Yih | |
| 5,282,635 | A | 2/1994 | Hopkins | |
| 5,288,071 | A | 2/1994 | Solomon | |
| 5,435,570 | A * | 7/1995 | Labrasseur | 273/355 |
| 5,690,330 | A | 11/1997 | Ozawa | |
| 5,709,385 | A | 1/1998 | Fitzpatrick et al. | |
| 5,769,424 | A * | 6/1998 | Kelly et al. | 273/352 |
| 5,819,998 | A | 10/1998 | Chehebar | |
| 5,851,012 | A | 12/1998 | Langieri et al. | |
| 5,863,043 | A | 1/1999 | Bitner | |
| 5,967,513 | A | 10/1999 | Wells | |
| 5,988,636 | A | 11/1999 | Kilmer | |
| 6,102,405 | A | 8/2000 | Spikes | |
| 6,267,377 | B1 | 7/2001 | Griggs | |
| 6,332,615 | B1 | 12/2001 | Watanabe | |
| 6,651,984 | B1 | 11/2003 | Luken | |
| 6,669,200 | B1 | 12/2003 | Knetsch et al. | |
| 6,837,769 | B1 | 1/2005 | Skov et al. | |
| 6,843,477 | B2 | 1/2005 | Simmons, Jr. | |
| 7,017,908 | B1 | 3/2006 | Tan et al. | |
| 7,207,564 | B2 | 4/2007 | Bedford et al. | |
| 7,222,859 | B2 | 5/2007 | Mitvalsky | |
| 7,367,564 | B2 | 5/2008 | Latell | |
| 2004/0090007 | A1 | 5/2004 | Simmons, Jr. | |
| 2004/0173968 | A1 | 9/2004 | Mitvalsky | |
| 2005/0189716 | A1 | 9/2005 | Yu | |
| 2005/0194743 | A1 | 9/2005 | Mitvalsky | |
| 2007/0108703 | A1 | 5/2007 | Ritter | |
| 2007/0216102 | A1 | 9/2007 | Matilla et al. | |

OTHER PUBLICATIONS

Written Opinion of the International Searching Authority for PCT/US2009/054511 dated Apr. 1, 2010.

* cited by examiner

GAME

CROSS REFERENCE TO RELATED APPLICATIONS

The present application claims the benefit of U.S. Provisional Patent Application Ser. No. 61/090,241, filed Aug. 20, 2008, the contents of which are incorporated herein by reference thereto.

BACKGROUND

Card games are known to provide fun and entertainment to players of all ages. Players may also enjoy the experience of a card game played in a manner that requires interaction in the game as well as other players. Accordingly, it is desirable to provide a game providing both enjoyment and such interaction.

SUMMARY OF THE INVENTION

In one embodiment, a game having a plurality of game cards, a plurality of targets, a plurality of objects; and a launcher for launching at least one of the objects at one of the plurality of targets is disclosed. The game also includes at least one special game card, the at least one special game card being played to launch one of the plurality of objects at one of the plurality of targets.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
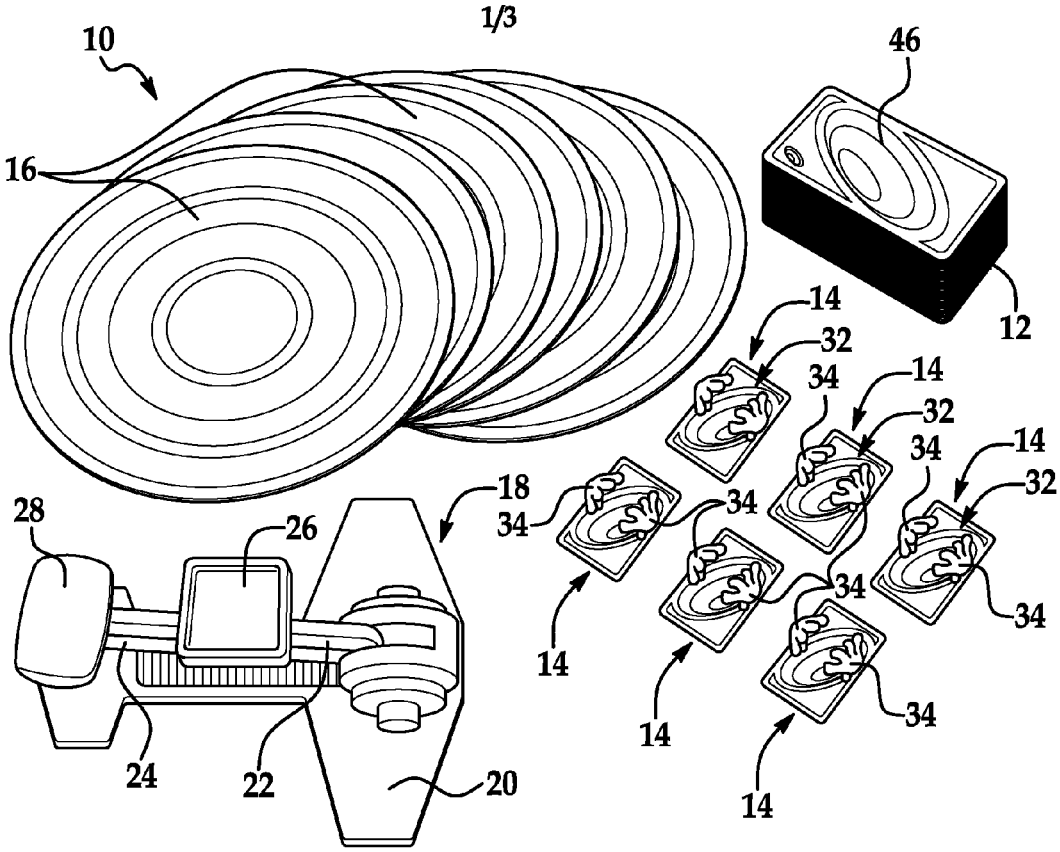
FIGS. 1-4 illustrate a game embodying a non-limiting embodiment of the present invention.
Figure 2:
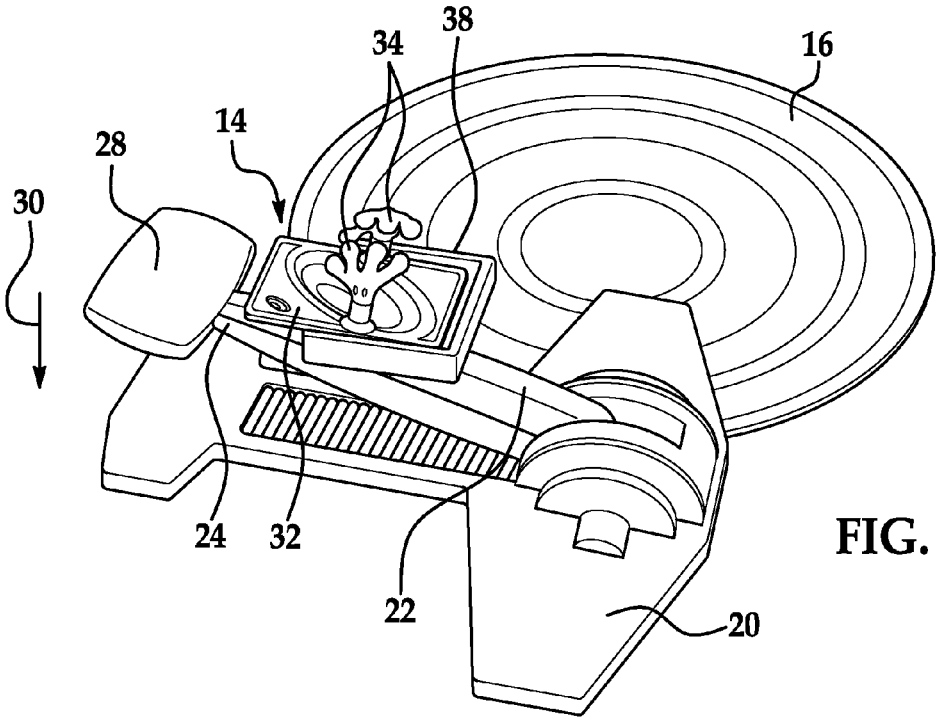
Figure 3:
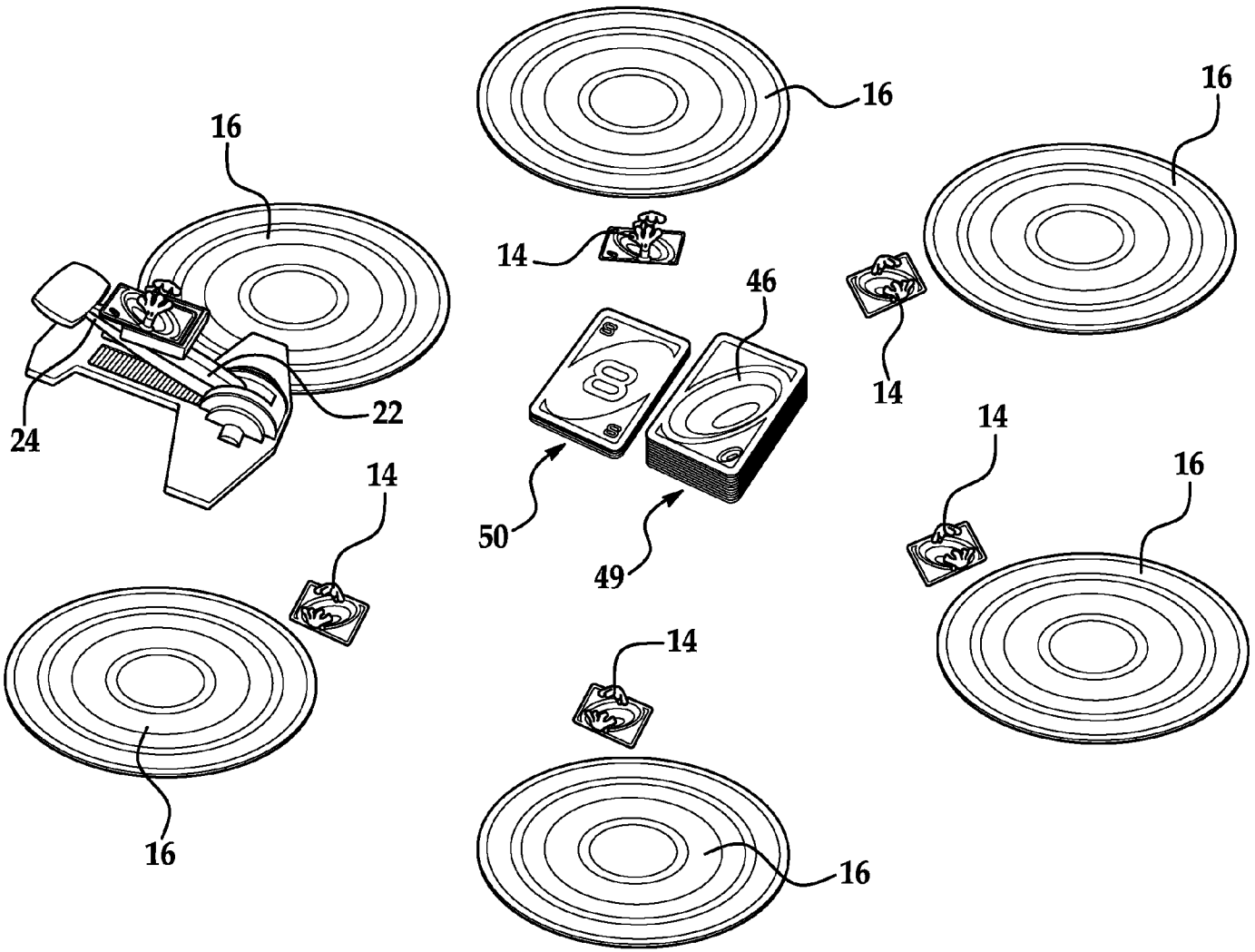
Figure 4:
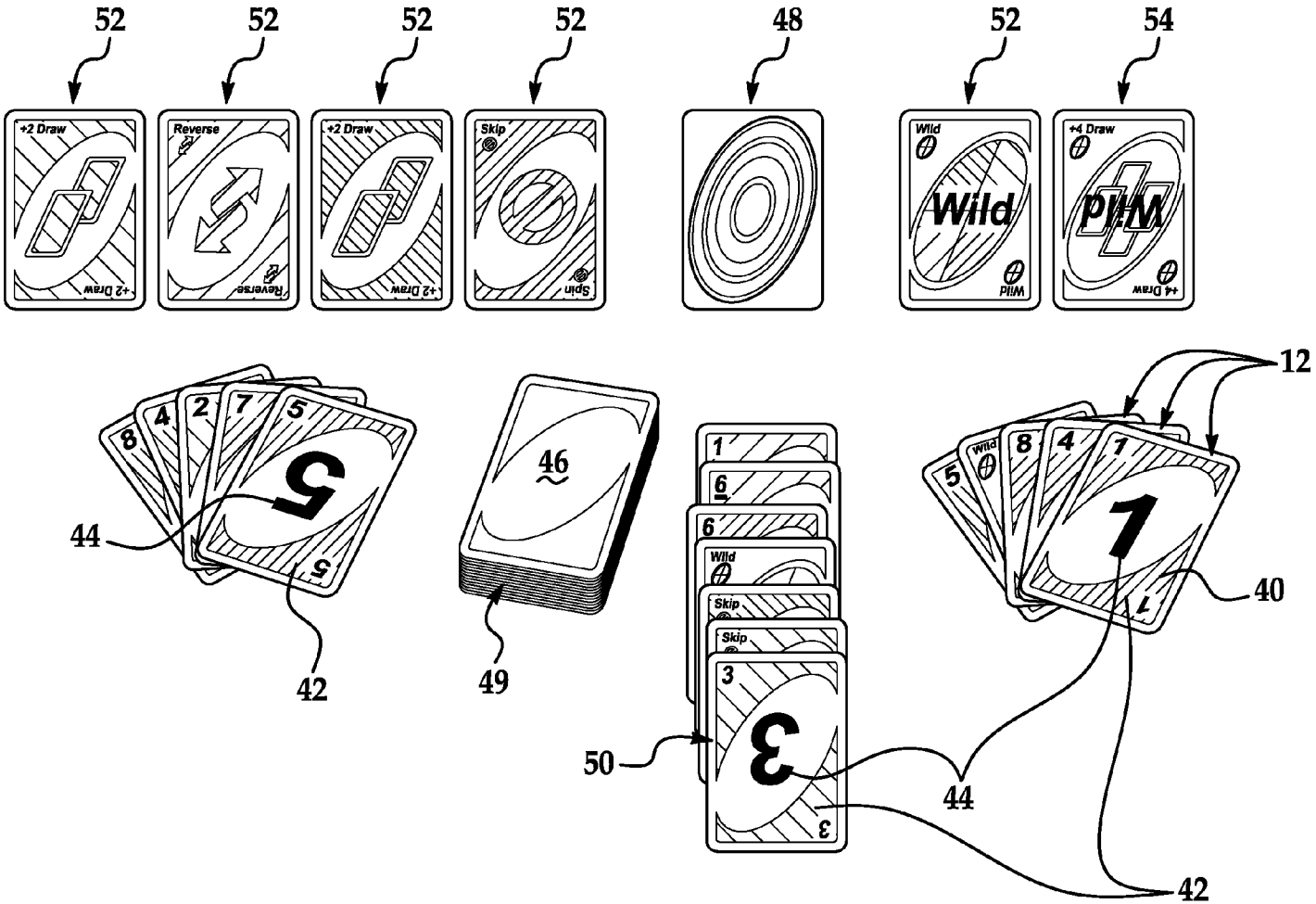

Referring to FIG. 1, a game 10, having a series or collection of game pieces such as cards or game cards 12, and an apparatus for use with the game cards is shown. In one non-limiting embodiment of the game 10, a plurality of objects 14 are also provided. The game will also include a number of targets 16 which, along with an object 14 are distributed to the players upon commencement of the game. The game also includes at least one launcher 18 for launching the objects at least one of the targets. The launching of the objects at the targets is a portion of a game played with the game cards.

In one embodiment, the launcher is configured to launch objects as a catapult. As illustrated in one non-limiting embodiment the launcher includes a base member 20, a first arm member 22, and a second arm member 24 each of which are pivotably mounted to the base member. As illustrated, the fist arm member is pivotably mounted to the platform at one end and has a launch surface 26 at another end. The second arm member is also pivotably mounted to the base at one end and has a trigger portion 28 at another end. In accordance with an exemplary embodiment of the present invention, the ends of the first and second arm members are configured to interact with each other (e.g., geared surfaces or other equivalent means) wherein application of a force to the trigger portion of the second arm member downward in the direction of arrow 30 will cause the first arm member and the launch surface to move in a direction opposite to arrow 30 thereby moving the platform upward abruptly until it reaches a point or limit of travel upward and stops and an object placed on the launch platform will then fly in the air. In one embodiment, the launcher is constructed out of a easily formed material such as plastic and the arm members comprises a resilient, flexible material such as plastic, spring steel or the like, which allows repeated, flexible bending without deformation. In one alternative embodiment, arm 22 is biased by a spring member attached to provide a biasing force to the arm when the same is in a cocked position and a trigger is used to release the spring member and move the arm. It being understood that the aforementioned description of the launcher is merely provided as an illustrative example and embodiments of the present invention are not intended to be limited to the specific embodiments described herein.

In one embodiment, the object will comprise a planar member 32 having a dimension and configuration similar to that of the playing cards. In addition, at least one figure or 3-dimensional portion 34 depends away from an upper surface of the planar member to create a unique configuration. In one embodiment and as illustrated, a pair of portions 34 are provided on each planar member at opposite sides and are positioned in a facing spaced relationship. Furthermore and in one non-limiting embodiment, the pair of portions are configured as a pair hands extending away from the upper surface of the planar member. In an alternative embodiment, the object may have any configuration suitable for launching by the launcher. Thus, it is understood that the aforementioned description of the object is merely provided as an illustrative example and embodiments of the present invention are not intended to be limited to the specific embodiments described herein. For example, the object may be any one of figures, figurines or any 3-dimensional object resembling any type of item (e.g., animal, human, humanoid, robot, character, etc) that is capable of being launched by the launcher.

In one non-limiting embodiment, the launch surface will have a peripheral wall portion 38 on at least one side of the platform to retain the object on the launch surface during launching of the object. In one non-limiting embodiment, the planar surface of the object is of a configuration similar to that of the game cards and the portions are disposed on either side of the planar member to provide some stability to the object as it is launched through the air at a target.

During game play the launcher is used during certain game activities wherein the launcher is positioned or aimed in the direction of an opposing player's target 16 and the player using the launcher launches his or her object at the opponents target to achieve an intended result, which will be described herein.

Referring now to FIGS. 1-4, the number of game cards 12 may vary depending upon the particular rules of the game. In one non-limiting embodiment, the game cards 12 will have at least one surface 40 which can accommodate the placement thereon of a first identifier 42 and a common identifier 44. The identifiers 42, 44 are affixed to one side of the card through printing, painting, molding, through the use of an adhesive backed appliqué or any other suitable method for permanently applying the identifiers to the game cards 12 while an opposite side of the card has a non-descript decorative indicia 46 applied thereto such that all of the cards look the same on one side. In one non-limiting exemplary embodiment, the first identifier is a color (e.g., red, blue, yellow, green, or any color) and the second identifier is a number, character, symbol etc. Of course, any type of recognizable indicia or shape may be used as the first identifier and the common identifier.

The game cards may comprise a plurality of sub-sets with each sub-set including game cards having at least a first identifier 42 and a common (i.e. to the subset) identifier 44. Each first identifier in a sub-set is common with at least one other first identifier of another subset. In addition, special game cards, such as "Bulls Eye" cards 48 are also included in the game with each special game card having a particular use during game play (e.g., involving the use of the launcher for launching an object at an opponent's target). Of course, other types of game cards are contemplated for use with the exemplary embodiments of the present invention. Here any type of card set may be used as long as at least one of the special "Bulls Eye" cards mentioned below is in the deck.

One non-limiting example of game play will now be described below: first each player will be assigned a target 16 and an object 14 and then the deck of cards 12 is shuffled and a predetermined about of cards are dealt to each player. After that the remaining cards are placed in a central location with each of the assigned targets positioned proximate to a player. The remaining cards provide a draw pile 49 and one card from the draw pile is turned face up as a displayed game card 50 so that the first and common identifiers of that card are visible.

A second player (e.g., left or right of the dealer) observes the displayed game card 50 and compares the identifiers 42, 44 of the card with those drawn earlier by him or her. If either of the identifiers 42, 44 of the dealer displayed game card matches an identifier of a game card in the second player's collection of previously drawn cards, the player may discard his or her matching game card, which now becomes the displayed game card. If a matching card is not in the second player's collection of previously drawn cards, the player must take another card from the draw pile and if the identifiers 42, 44 of the drawn card match those of the displayed card the drawn card can be played, if not the drawn card is added to that player's hand and the turn advances. In an alternative embodiment of game play the player can keep drawing until the identifiers 42, 44 of a drawn card match those of the displayed card. For example, is the displayed game card 50 is a "blue 3" the next player may play any blue card or any card with the number 3 regardless of color. In addition, they may play a wild Card or a Wild Card+4 or the Bulls Eye Card.

In either case, a new card is displayed or the previous card stays displayed and the next player must match the displayed card (e.g., old or new). The object of the game is to be the first player to discard all of their cards. One exemplary format for playing or a set of rules for playing this game is similar to that of UNO. Another example format would be that of a class of games referred to a "shedding games" in which the overall object of the game is to be the first player to return or discard all of his or her cards. Of course, other card games are contemplated to used in accordance with an exemplary embodiments of the present invention again as long as a special "Bulls Eye" card or feature for using the launcher is included in the card set.

Depending on the particular game rules, special game cards 52 may allow a player to take particular actions which are not described above. For example, the special game cards are played as wild cards or trump pieces which allows them to match any displayed card and also allows the user to pick or choose the next identifier (e.g., color and/or character). Thus, these special game cards may be more valuable than other game cards. It is also understood that more than one special game card can be in the plurality of game cards and the different special game cards can be provided. Non-limiting examples include a game card that causes the next player to skip his or her turn, pick a number of card from the draw stack and skip their turn, reverse direction of game play (e.g., change who goes next), change at least one identifier of the game card on the playing surface, etc. The special game pieces add additional excitement and intrigue to the game.

As discussed above, the Bulls Eye Card 48 gives that player the right to take the launcher and launch their object at any other player's target. In one embodiment, the Bulls Eye Card may be played any time like a wild card or the Bulls Eye Card will also have a first identifier such as color allowing it to be played when the color of the Bulls Eye Card matches the displayed card or if the previous played card (e.g., displayed card) is a Bulls Eye Card (e.g., in one embodiment, there will be more than one Bulls Eye Card in a deck). Here it would be best to choose the opponent who has the fewest cards or is closest to winning since if the launched object lands on the opponent's target, the player launching the object gets to take one card out of his or her hand and give it to the opponent whose target has just been hit. Still other variations may be employed with the various embodiments of the present invention. If on the other hand the object misses the opponent's target, nothing happens. In one embodiment, the Bulls Eye Card can be played anytime or only when an identifier of the Bulls Eye Card matches the displayed game card.

In an alternative embodiment, a Wild Draw 4 card 54 is provided, which can also be employed as a Bulls Eye Card or as a replacement to the Bulls Eye Card. Typically, a Wild Draw Card allows the person playing it to play it any time (wild card) select any continuing color and cause the next player to pick up four cards from the draw pile and lose a turn. In this variation, they are played as Bulls Eye cards. The difference here is that there is a penalty if the launching player misses his/her opponent's target. For example, if the object hits the opponent's target, the opponent has to draw 4 cards; on the other hand if object misses the opponent's target, the player launching the object has to draw 4 cards. In one non-limiting embodiment, a deck of 112 cards is provided with 20 Bulls Eye cards. It being understood that numerous variations are considered to be with the scope of exemplary embodiments of the present invention.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

The invention claimed is:

1. A game comprising;

a plurality of game cards;

a plurality of targets;

a plurality of objects;

a launcher for launching one of the plurality of objects, wherein the launcher has a first arm member and a second arm member, the first arm member being pivotably mounted to a base at one end and has a launch surface at another end and the second arm member being pivotably mounted to the base at one end and has a trigger portion at another end, wherein application of a force to the trigger portion of the second arm member downward in a first direction will cause the first arm member and the launch surface to move in a direction opposite to first direction until one of the plurality of objects placed on the launch surface will be launched from the launcher; and at least one special game card, the at least one special game card must be played to launch one of the plurality of objects at one of the plurality of targets.

2. The game as in claim 1, wherein the plurality of game cards further comprise:

a plurality of sub-sets, the game cards in each subset having a common identifier and a first identifier, each first identifier being common with at least one first identifier of another sub-set.

3. The game as in claim 2, wherein the first identifier is color and the common identifier is numerical value.

4. The game as in claim 1, wherein each of the plurality of objects has a planar member and a three dimensional portion that depends away from a surface of the planar member.

5. The game as in claim 4, wherein three dimensional portion is a pair of objects mounted on either side of the planar member and the pair of objects are in a facing spaced relationship.

6. The game as in claim 4, wherein the planar member is the same shape as each of the plurality of game cards.

7. The game as in claim 4, wherein the launcher further comprises a peripheral wall portion disposed about a portion of the launch surface, the peripheral wall portion being configured to engage the planar member when the planar member is positioned on the launch surface.

8. The game as in claim 5, wherein the pair of objects are shaped as hands.

9. The game as in claim 8, wherein the plurality of game cards further comprise:

a plurality of sub-sets, the game cards in each subset having a common identifier and a first identifier, each first identifier being common with at least one first identifier of another sub-set.

10. The game as in claim 7, wherein the plurality of game cards further comprise:

a plurality of sub-sets, the game cards in each subset having a common identifier and a first identifier, each first identifier being common with at least one first identifier of another sub-set.

11. The game as in claim 1, wherein the plurality of game cards further comprise:

a plurality of sub-sets, the game cards in each subset having a common identifier and a first identifier, each first identifier being common with at least one first identifier of another sub-set.

12. The game as in claim 11, wherein the first identifier is color and the common identifier is numerical value and wherein each of the plurality of objects has a planar member and a three dimensional portion that depends away from a surface of the planar member.

13. The game as in claim 12, wherein three dimensional portion is a pair of objects mounted on either side of the planar member and the pair of objects are in a facing spaced relationship and wherein the planar member is the same shape as each of the plurality of game cards.

14. A game comprising;

a plurality of game cards;

a plurality of targets;

a plurality of objects;

a catapult for launching one of the plurality of objects, wherein the launcher has a first arm member and a second arm member each being pivotally secured to a base and cooperating with each other, wherein application of a force to the first arm member in a first direction will cause the second arm member to move in a direction opposite to first direction until one of the plurality of objects placed on a launch surface of the second arm member is launched from the catapult; and at least one special game card, the at least one special game card must be played to launch one of the plurality of objects at one of the plurality of targets.

* * * * *